US005352558A

United States Patent [19]

Simms et al.

[11] Patent Number: 5,352,558

[45] Date of Patent: Oct. 4, 1994

[54] TONER DISPERSANT ABSORPTION BELT SYSTEM

[75] Inventors: Robert Simms, Downingtown, Pa.; Tab Tress, Henrietta, N.Y.; Dana Smith, Wilmington, Del.

[73] Assignee: Xerox Corporation, Stamford, Conn.

[21] Appl. No.: 82,141

[22] Filed: Apr. 12, 1993

Related U.S. Application Data

[63] Continuation of Ser. No. 779,559, Oct. 18, 1991, abandoned.

[51] Int. Cl.[5] ..... G03G 21/00

[52] U.S. Cl. ..... 430/125; 355/214; 355/256; 355/296; 34/95; 34/335

[58] Field of Search ..... 430/125; 355/296, 304, 355/300, 298, 273, 256, 214; 34/335, 336, 95

[56] References Cited

U.S. PATENT DOCUMENTS

| | | | |
|---|---|---|---|
| 3,955,533 | 5/1976 | Smith et al. | 118/637 |
| 4,089,683 | 5/1978 | Knieser | 96/124 |
| 4,258,115 | 3/1981 | Magome et al. | 430/125 |
| 4,263,391 | 4/1981 | Saito et al. | 430/125 |
| 4,286,039 | 8/1981 | Landa et al. | 430/119 |
| 4,299,902 | 11/1981 | Soma et al. | 430/125 |
| 4,392,742 | 7/1983 | Landa | 355/15 |
| 4,533,235 | 8/1985 | Uchida | 355/15 |
| 4,650,311 | 3/1987 | Mayer | 355/15 |
| 4,985,733 | 1/1991 | Kurotori et al. | 355/282 |
| 5,028,964 | 1/1991 | Landa et al. | 355/273 |

*Primary Examiner*—Marion E. McCamish
*Assistant Examiner*—Rosemary Ashton
*Attorney, Agent, or Firm*—Oliff & Berridge

[57] ABSTRACT

A device for increasing the solids content of an image formed from liquid developer comprising a belt which is comprised of an absorption material containing small pores to absorb dispersant from a dispersant laden image and a pair of rollers bearing the belt wherein the belt on one of the rollers contacts a dispersant laden image bearing portion of an image carrying member such as a photoreceptor drum or an intermediate sheet.

34 Claims, 2 Drawing Sheets

TONER DISPERSANT ABSORPTION BELT SYSTEM

This is a continuation of application No. 07/779,559 filed Oct. 18, 1991, now abandoned.

BACKGROUND OF THE INVENTION

1. Field of the Invention

This invention relates to a device and method for removing toner dispersant from an image formed from a liquid developer.

2. Description of the Prior Art

A typical electrostatographic printing machine (such as a photocopier, laser printer, facsimile machine or the like) employs an imaging member that is exposed to an image to be printed. Exposure of the imaging member records an electrostatic latent image on it corresponding to the informational areas contained within the image to be printed. The latent image is developed by bringing a developer material into contact therewith. The developed image recorded on the photoconductive member is transferred to a support material such as paper, either directly or via an intermediate transport member. The developed image on the support material is generally subjected to heat and/or pressure to permanently fuse it thereto.

Two types of developer materials are typically employed in electrostatographic printing machines. One type of developer material is known as dry developer material and comprises toner particles or carrier granules having toner particles adhering triboelectrically thereto. Another type of developer material is a liquid material comprising a liquid carrier or dispersant having toner particles dispersed therein.

When using a liquid developer material, excess liquid carrier such as Isopar (a non-polar decane solvent) frequently adheres to the photoconductive member and is transferred to the transport member (if any) and support material. This liquid carrier later evaporates into the air. Usually about 0.5 grams of liquid carrier is absorbed by the copy paper and carried out in each copy.

As the image is fused to the paper by heating the toner above its melting point and allowing it to flow into the pores of the paper, the heat required to fuse the image vaporizes a large percentage of the liquid carrier. It is desirable to remove the liquid carrier from the support material to minimize image show through and to prevent problems associated with it emerging from support material later. Additionally, increasing the solids content of an image before transferring greatly improves the ability of the toner particles to form a high resolution image on the transport member and thus on the support material.

The amount of dispersant in the toned image can be limited by a metering system. The most common metering technique is the reverse roll.

Reverse roll doctoring and corona doctoring reduce the amount of liquid carried out by the copy sheet from about 0.5 grams to about 0.12 grams per copy. Reverse roll doctoring provides superior background clean-up by having sufficient shear force to remove all the liquid carrier except the liquid carrier electrostatically bonded to the toner particles. However, very close spacing is required to do an effective job. It is particularly difficult to maintain this close spacing over large dimensions in applications such as color proofing masters and other graphic arts.

An air knife can also remove excess liquid carrier. However, the toner particles adhering to the latent image may also be removed, thereby disturbing the image.

Various other techniques have been devised for removing excess liquid carrier from an imaging member.

U.S. Pat. No. 3,955,533 (Smith et al.) discloses a squeegee roller system for removing excess developer liquid from the developer-image-bearing photoconductive surface of a drum or the like. The squeegee roller has a covering of a predetermined hardness which is biased with a predetermined force against the moving surface carrying a developed image to cause excess developer to flow into a receptacle.

U.S. Pat. No. 4,089,683 (Knieser) discloses a liquid developer cleaning means which includes a foam-backed belt having a working surface pattern of ridges and grooves. The foam-backed belt is mounted on two guide rolls rotatable about a shaft and positioned such that the movable belt advances during operation in a direction of an axis upon which a drum having an image surface thereon rotates. The purpose of the belt is to clean any residual developer after the toner laden image has been transferred from the drum.

U.S. Pat. No. 4,258,115 (Magome et al.) discloses a wet developing method which includes the use of an elastic roller for collecting excess developing liquid and thereby effecting further development of an electrostatic image at the development station. The elastic roller is comprised of a shaft formed of a rigid material, an elastic foam member surrounding the shaft, and a netting which is supported around the foam member. The elastic roller may be in the shape of a belt.

U.S. Pat. No. 4,263,391 (Saito et al.) discloses a liquid development process which includes a transfer step, and a cleaning step for cleaning a surface of a latent image carrying member. An elastic rotary member may be used to clean the latent image carrying member. The elastic rotary member is made of an electroconductive rigid core member, an electroconductive porous elastic member capable of retaining a liquid therein and provided around the core member, and a liquid-permeable insulating flexible member surrounding an outer periphery of the elastic member. The elastic rotary member is maintained in pressure contact with the latent image carrying member. The liquid absorbed may be squeezed out through the meshes of the elastic member when the elastic member is compressed.

U.S. Pat. No. 4,299,902 (Soma et al.) discloses an image forming process which utilizes an elastic roller or belt which squeezes out liquid developer and then absorbs excess liquid developer. The elastic roller or belt is used to apply developer to a latent image and absorb excessive liquid developer. Part of the roller or belt is kept in a liquid developer reservoir.

In U.S. Pat. No. 4,985,733 (Kurotori et al.) an image fixing unit for a wet-type electrophotographic copying machine comprises a blotter roller which absorbs a carrier liquid component, such as Isopar, contained in a developer deposited imagewise by an image-transfer charger on a transfer sheet. The blotter roller is comprised of a porous material such as a non-woven fabric or cotton and an elastic material such as silicone rubber. The transfer sheet is transported into an image fixing unit wherein a pressure-application roller is in contact with a heat-application roller, such that a toner image formed on the transfer sheet is thermally fixed thereto, while the transfer sheet passes through a nip between the heat-application roller and the pressure-application roller. The blotter roller is in contact with a back-up roller with a predetermined pressure. A cleaning brush roller may be used to clean the blotter roller.

U.S. Pat. No. 5,028,964 (Landa et al.) discloses an apparatus for image transfer which comprises an intermediate transfer member and a squeegee for removing excess liquid from the toner image prior to transferring an image. The intermediate transfer member is operative for receiving the toner image therefrom and for transferring the toner image to a receiving substrate. Transfer of the image to the intermediate transfer member is aided by providing electrification of the intermediate transfer member to a voltage having the same bias as that of the charge particles.

U.S. Pat. No. 4,286,039 (Landa et al) discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 4,392,742 (Landa) discloses a cleaning system for a liquid developer electrostatographic copier comprising a roller formed with a resilient material, such as a closed-cell elastomer, having externally exposed, internally isolated surface cells. During an operation, the excess liquid on an imaging surface is absorbed by the cleaning roller. The cleaning roller is then compressed to squeeze out liquid from the roller, leaving the roller dry.

Each of these methods and devices have certain limitations. Some of the devices such as that of U.S. Pat. No. 4,089,683 clean up the residual developer only after the toner laden image has been transferred from the drum. Some of the other methods and devices discussed above serve to collect and distribute excess developing fluid over the electrostatic image, and do not remove excess and unwanted developing liquid. Other systems use rollers to absorb excess developer liquid from the developer image bearing photoconductive surface of the drum.

SUMMARY OF THE INVENTION

An object of this invention is to remove as much dispersant or Isopar as possible prior to fusing where the excess dispersant is vaporized.

A further object is to remove the excess dispersant in a liquid stage where it can be recovered by squeezing or wringing the foam out. Another object of the invention is to remove all of the dispersant possible except for the amount required for the remaining process steps. In the case of an intermediate transfer system utilizing a transfix stage, no dispersant is required to complete the process.

These and other objects are achieved by a device and method to transfer an image to a nonabsorbing intermediate after low pressure blotting or dispersant absorption by means of a belt. The proposed method for increasing the solids content of an image formed from liquid developer comprises contacting a belt comprised of porous absorption material to a toner dispersant laden image downstream from a developer station, and removing the absorbed dispersant from the absorption material. The method further comprises contacting the absorbed material belt to the toner dispersant laden image by passing the absorption material belt over a contact roller and a backup roller. The method further comprises biasing the contact roller with an electrical charge which is the same as a charge of the toner particles in the dispersant such that a resulting electric field repels the toner particles from the absorption material so that minimal toner particles are transferred to the absorption material.

DETAILED DESCRIPTION OF PREFERRED EMBODIMENTS

In the invention, an absorption material belt system is used to draw off liquid toner dispersant such as Isopar from a dispersant laden image that is located on an image carrying member such as an electrostatographic imaging member or intermediate member downstream from the development station. The exit and entrance angles of the belt removing the dispersant can be controlled or manipulated to maintain the proper cohesiveness of the image and of the shear forces, particularly at higher process speeds. By adjusting the angles of the belt, there is less turbulence as the dispersant is being absorbed by the absorption material, thereby allowing the dispersant to be absorbed at the same rate that the absorption material belt is contacting the image. More specifically, the dispersant is removed by passing an absorption material belt over a roller biased with the same charge as that of the toner. The bias repels the toner particles while allowing the dispersant to be absorbed. In an especially preferred embodiment, a conductive or semiconductive absorbent material is used with a biased roller. This allows the roller's electrical field to approach more closely to the toned image and thus exert a stronger repelling action than if the biased roller were separated from the toner image by an insulating absorbent material. In the case of a multilayer medium, individual layers can be made conductive so that the overall thickness of the medium has little effect.

Figure 1:
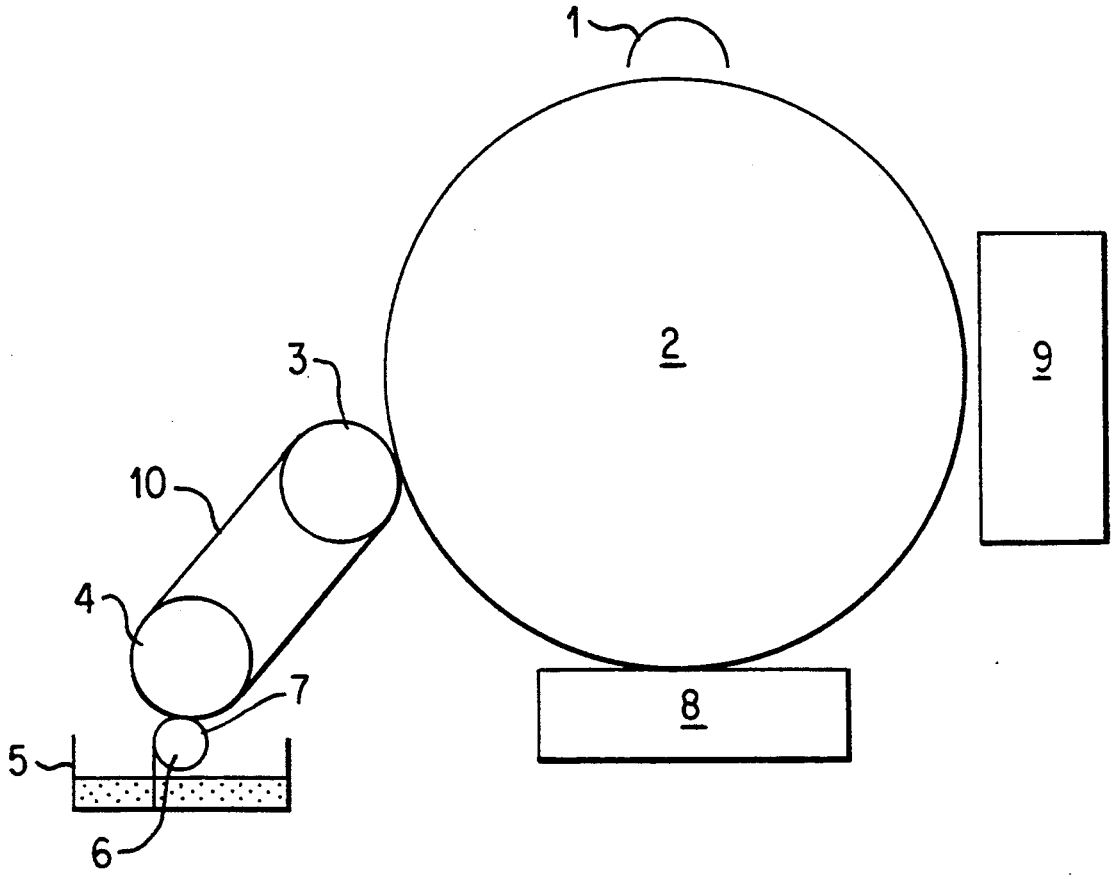
FIG. 1 is a schematic view of an electrophotographic printing machine incorporating the features of the present invention therein.

FIG. 1 shows an absorption material belt 10 removing excess dispersant from a toner dispersant laden image on an imaging member 2. While a drum is shown in FIG. 1, the invention is equally useful with a belt-type imaging member. Suitable imaging members include known photoreceptors and ionic receptors. The drum 2 rotates to the bias pressure roller 3. The belt 10 is comprised of an absorption material which passes around the bias pressure roller and a backup roller 4. This absorption material 10 which contains small pores to absorb the toner dispersant is brought into contact with the dispersant laden image. Capillary action absorbs the dispersant into the absorption material.

The absorption material may be any suitable material, preferably a foam such as one selected from the group consisting of Vyon ® (a high density microporous material), Permair ® (a microporous polyurethane material), Tetratex ® (a microporous semipermeable membrane), and "E" Foam. Foams with a contact surface that have an appearance of being glossy and non-porous though they are truly very porous are the greatest contributors to dispersant removal in the background areas, due to intimate contact with the image and to the fact that they cause the least amount of image loss or degradation. Top surface materials for good absorption and conformability characteristics should have on their surface some gloss in appearance and yet be very porous. When dispersant is dripped onto the material surface with an eye dropper, the fluid should be wicked into the material in less than 250 msec. The best surface characteristics have been found in materials that, due to "surface tension" are surface hydrophobic yet readily absorb dispersant. The material must, of course, be compatible with whatever dispersant material is used.

Pore sizes of the absorbent material of about 0.2 to about 30 microns do very well, although the end product may use pore sizes outside these limits. Very small pores of a micron or less do an excellent job of absorbing the dispersant out of an image and off the background, though extracting the dispersant requires more pressure due to the increased capillary pressure. However, such a material could be used between an absorbing foam and the porous roller as a barrier to allow Isopar to absorb into the foam through the barrier but not allow it to rewet.

The volume porosity of the foam is a parameter that must be taken into account when a roller or other physical pressure is used to compact the image and to expel the dispersant so as to avoid overcompressing the foam pores and thus reducing or eliminating absorption from the image. Nominally at very low pressures the foam porosity can go as high as about 80% to about 95% and as low as about 5% to about 15% whereas at high pressure the high figure could go down depending on the durometer and strength of the material.

The amount of toner removed from an image onto the surface of absorbent material belt depends upon the surface texture of the Isopar removal medium. A greater surface texture allows for the embedding of toner particles into the irregularities of the surface of the absorption material belt. Thus, a smoother glossy surface with small pores will allow fewer toner particles to become embedded.

Additionally, the surface energy of the absorbent material's surface greatly influences the amount of toner removed from the image when there is little or no electric field compressing the image away from the foam. The material can be made of a layer of materials, each possessing the necessary requirements of that layer.

The bias pressure-roller 3 is biased with an electrical charge which is the same as the charge of the toner particles in the dispersant, such that the resulting electric field repels the toner particles from the absorption material so that minimal toner particles are transferred to the absorption material 10. Pressure may be applied to the dispersant laden image by the roller 3, thereby reducing the pile height of the image and increasing the amount of dispersant being absorbed.

At nominally low bias roller pressures with a field applied across the image, the percent solids of the image will go from 15% after development to about 30% up to about 40% after dispersant absorption. With pressure applied to the bias roller compacting the image, this latter figure will continue to increase the percent solids of the image to approximately 50% to about 70%. To accomplish this compression of image while absorption of the dispersant takes place, the compressible strength of the absorbent material must be greater than the force exerting onto it so that the interspatial voids or capillary paths within the absorption material are not eliminated or brought to saturation by the constriction.

After the absorption material belt 10 absorbs the dispersant, it travels around the backup roller 4 which is in contact with a squeeze roller 7. This squeeze roller 7, which acts as a squeegee, removes the dispersant from the absorption material belt 10. A blade 6 removes dispersant from the squeeze roller 7. The dispersant is collected in a dispersant collection tray 5. The belt 10 continues traveling around the backup roller 4 to again contact the imaging member 2 at a point between the bias pressure roller 3 and imaging member 2 such that immediately prior to a portion of the belt 10 contacting imaging member 2, the portion of the belt 10 is in an uncompressed state having any previously absorbed toner dispersant removed from the belt 10. The image generating belt or drum 2 continues to rotate to the point where a transfer corotron 1 or another known mechanism transfers the image to an intermediate belt or other type of commonly known image receiving members. Thus, transfer corotron 1 constitutes an image transfer station. The image generating belt or drum 2 continues to travel to station 9 where the drum 2 is erased and a new electrostatic image formation takes place. It then proceeds to development in metering station 8 (also commonly referred to as a development station) which is the point at which the dispersant developer is applied to the electrostatic image.

After dispersant has been removed from a number of images, it is most probable that the outer surface of the belt would begin to get a finite layer of toner particles onto it. There are many possible ways to remove these toner particles such as a felt wiper positioned against the belt 10 to scrub these particles off along with any other debris that may adhere to the belt 10.

Another method is to bias the dispersant squeeze roller 7 of opposite polarity to that of the toner, thus transferring the toner deposits to the roll which may be wiped off with a urethane or similar blade 6.

Figure 2:
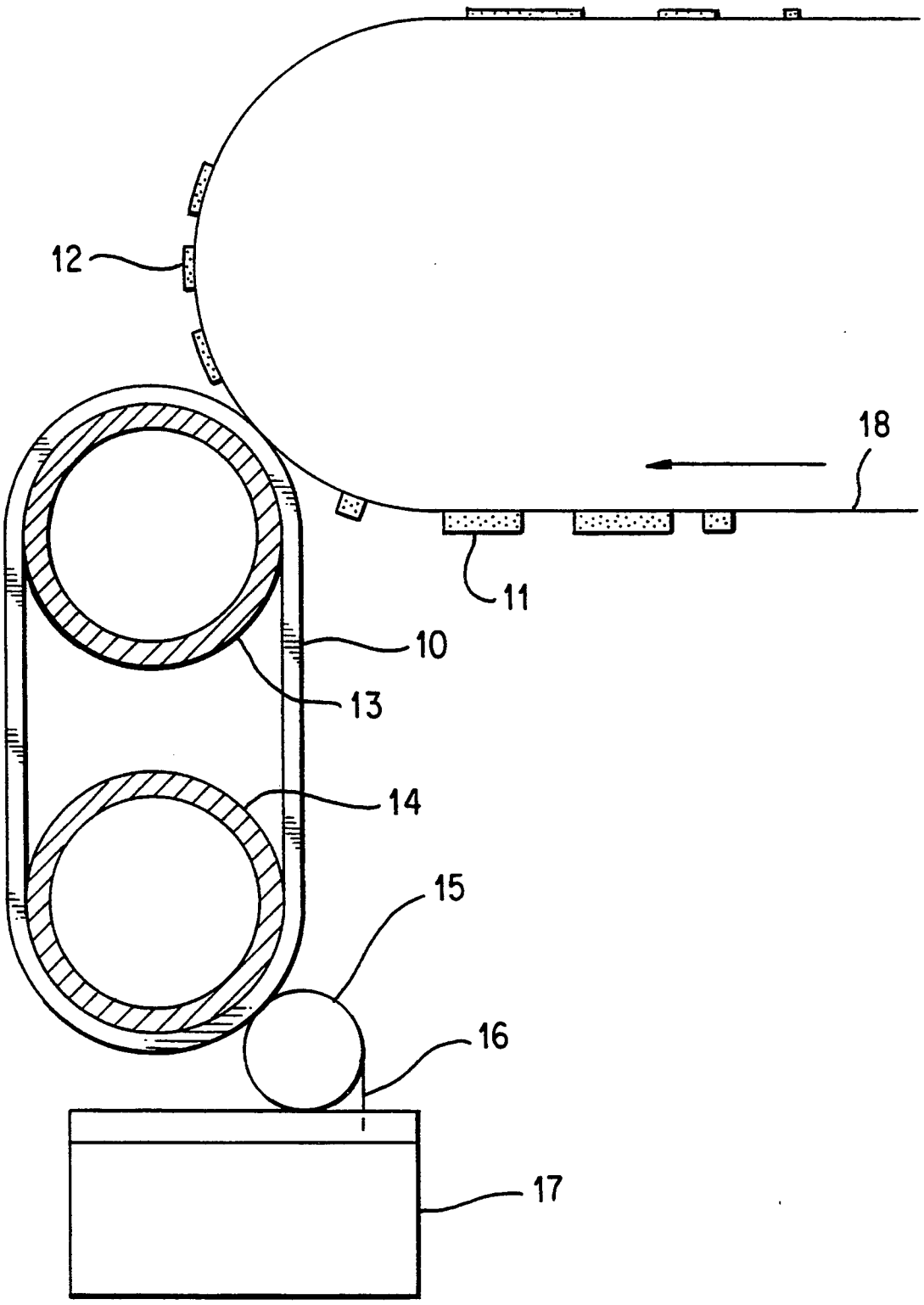
FIG. 2 is a schematic view of the invention wherein the excess dispersant is removed from the toner image on the intermediate belt.

In the embodiment of FIG. 2, the absorption material belt 10 excess dispersant is removed from a toner image placed on an intermediate transport belt 18, the toner image 11 having been transferred from a photoreceptor drum. As shown in FIG. 1, the absorption material belt 10 absorbs the dispersant through a series of pores in the foam. At the same time, the pressure roller 13 is compacting the image and increasing the percent solids up to approximately 50% to about 70%. As the absorbent material belt travels around the backup roller 14, a squeegee roller 15 removes the dispersant from the absorbent material belt 10. In FIG. 2, the dispersant removal squeegee roller has an opposite polarity to that of the toner, thus transferring the toner deposits to the roller which may be wiped with the urethane or similar blade 7. The Isopar is collected in a collection tray 17.

In roller absorption systems, the roller is or should be operating at the same speed as the photoreceptor drum. However, the squeeze roller often slows down the absorption roller, causing slippage and image disruption. This problem is virtually eliminated in the absorption material belt system due to the elasticity of the belt and the fact that the squeezing of the belt to remove the Isopar occurs at a greater distance away from the point where the absorption material belt is in contact with the image on the photoreceptor drum, resulting in less disturbance of the image. The belt system also allows more effective use of space at high speeds and isolation of the torque applied during the squeegee step to improve motion control and registration.

It is therefore apparent that there has been provided in accordance with the present invention a method and apparatus for increasing the solids content of an image formed from liquid developer that fully satisfies the aims and advantages herein before set forth. While this invention has been described in conjunction with a specific embodiment thereof, it is evident that many alternatives, modifications, and variations will be apparent to those skilled in the art. Accordingly, it is intended to embrace alternatives, modifications and variations that fall within the spirit and broad scope of the appended claims.

What is claimed is:

1. A method for increasing solids content of an image formed on an image carrying member, the image formed from a liquid developer at a developer station, the image comprising toner particles and liquid toner dispersant, the method comprising:

contacting a belt comprising an absorption material capable of absorbing the liquid toner dispersant to the image formed on the image carrying member, the belt contacting said image carrying member at a location separate from and downstream from the developer station and prior to transfer of the image to an image receiving member, said absorption material absorbing the toner dispersant and maintaining the toner particles on said image carrying member, said belt extending around a contact roller and a back up roller, said belt only contacting said image carrying member at a portion of said belt located between said image carrying member and said contact roller; and reducing an amount of absorbed liquid toner dispersant carried by said belt before said absorption material is contacted to a subsequent image on said image carrying member by removing said absorbed toner dispersant from said absorption material at said back up roller remote from said contact roller and said image carrying member so that immediately prior to said portion of said belt contacting said image on said image carrying member, said portion is in an uncompressed state having any previously absorbed liquid toner dispersant removed from said belt.

2. A method according to claim 1, further comprising biasing said contact roller with an electrical charge which is the same as a charge of toner particles in said dispersant, such that a resulting electric field repels said toner particles from said absorption material so that minimal toner particles are transferred to said absorption material.

3. The method according to claim 2, wherein said absorption material is electrically conductive.

4. The method according to claim 2, wherein said absorption material is electrically semi-conductive.

5. The method according to claim 1, wherein said absorption material is comprised of a foam.

6. The method according to claim 5, wherein said foam has a glossy surface.

7. The method according to claim 5, wherein volume porosity of said foam ranges from about 5% to about 95%.

8. The method according to claim 1, further comprising pressing the portion of said belt against said image with said contact roller, thereby reducing pile height of the image and increasing the amount of dispersant being absorbed.

9. The method according to claim 1, further comprising the step of removing said dispersant from said absorbent material by squeezing said absorbent material at said back up roller, thereby removing said dispersant in the form of a liquid.

10. The method according to claim 1, wherein said absorption material is comprised of pores, said pores ranging in size from about 0.2 microns to about 30 microns.

11. The method according to claim 1, wherein said image carrying member is a drum having a photoconductive surface.

12. The method according to claim 1, wherein said image carrying member is an intermediate transport member to which it has been electrostatically transferred from an electrostatographic imaging member.

13. The method according to claim 1, further comprising removing said dispersant from said absorption material belt at said back up roller by a squeegee.

14. The method according to claim 13, further comprising collecting and recycling said dispersant.

15. The method according to claim 1, wherein said reducing comprises passing said absorption material belt between said backup roller and a squeeze roller.

16. The method according to claim 15, further comprising removing said dispersant from said squeeze roller with a wiper blade and collecting said dispersant removed from said squeeze roller.

17. The method according to claim 16, further comprising biasing said squeeze roller with an electric charge which is of opposite polarity to the charge of said toner, thus transferring toner particles on said belt to the squeeze roller, and collecting said transferred toner particles.

18. A method according to claim 1, further comprising controlling an exit angle of the belt.

19. A method according to claim 18, further comprising controlling an entrance angle of the belt.

20. A method according to claim 1, further comprising controlling an entrance angle of the belt.

21. A device for increasing solids content of an image formed on an image carrying member, the image formed using a liquid developer at a developer station, the image comprising toner particles and liquid toner dispersant, the device comprising:

a belt at a location separate from and downstream from the developer station and upstream from a transfer station that transfers the image to an image receiving member, the belt comprising an absorption material capable of absorbing the liquid toner dispersant from the image on the image carrying member and maintaining the toner particles on said image carrying member, said belt extending around a contact roller and a back up roller, said belt only contacting said image carrying member at a portion of said belt located between said image carrying member and said contact roller; and means for reducing an amount of absorbed liquid toner dispersant carried by said belt after said belt absorbs said liquid dispersant from the image and before said absorption material contacts a subsequent image on said image carrying member by removing said absorbed liquid toner dispersant from said absorption material at said back up roller remote from said contact roller and said image carrying member so that immediately prior to said portion of said belt contacting said image, said portion is in an uncompressed state having previously absorbed toner dispersant removed from said belt.

22. The device according to claim 21, wherein said contact roller is an electrically conductive roller, said absorption material belt being contacted to the image by means of said electrically conductive roller, said electrically conductive roller being biased with an electrical charge which is the same charge as that of the toner particles, such that a resulting electric field repels said toner particles from said absorption material so that minimal toner particles are transferred to said absorption materials.

23. The device according to claim 22, wherein said absorption material belt is conductive.

24. The device according to claim 22, wherein said absorption material belt is semi-conductive.

25. The device according to claim 21, wherein said rollers are comprised of an elastomeric material.

26. The device according to claim 21, wherein said absorption material is comprised of a foam.

27. The device according to claim 26, wherein said foam is a glossy surface foam.

28. The device according to claim 27, wherein volume porosity of said absorption material ranges from about 5% to about 95%.

29. The device according to claim 21, wherein said dispersant is a toner solvent.

30. The device according to claim 21, wherein said absorption material is comprised of pores ranging in size from about 0.2 microns to about 30 microns.

31. The device according to claim 21, wherein said image carrying member is a drum having a photoconductive surface.

32. The device according to claim 30, wherein the image carrying member is an intermediate member, said image having been electrostatically transferred from said drum having said photoconductive surface to said intermediate member.

33. The device according to claim 21, wherein said absorption material belt is positioned between a squeeze roller and said back up roller, further comprising a blade which removes dispersant from said squeeze roller, said dispersant being collected in a dispersant collection tray.

34. The device for metering and extracting toner solvent according to claim 33, wherein said squeeze roller has an opposite polarity to that of the particles, thus transferring the toner particles to the squeeze roller, said particles being removed by said blade.

* * * * *